US012269632B2

(12) United States Patent
Marzaro

(10) Patent No.: US 12,269,632 B2
(45) Date of Patent: Apr. 8, 2025

(54) VACUUM PACKAGING MACHINE

(71) Applicant: SIRMAN S.P.A., Campo San Martino (IT)

(72) Inventor: Luca Marzaro, Campo San Martino (IT)

(73) Assignee: SIRMAN S.P.A., Campo San Martino (IT)

( * ) Notice: Subject to any disclaimer, the term of this patent is extended or adjusted under 35 U.S.C. 154(b) by 0 days.

(21) Appl. No.: 18/574,960

(22) PCT Filed: Jun. 27, 2022

(86) PCT No.: PCT/IT2022/050181
§ 371 (c)(1),
(2) Date: Dec. 28, 2023

(87) PCT Pub. No.: WO2023/286091
PCT Pub. Date: Jan. 19, 2023

(65) Prior Publication Data

US 2024/0351725 A1 Oct. 24, 2024

(30) Foreign Application Priority Data

Jul. 13, 2021 (IT) ..... 102021000018428

(51) Int. Cl.
*B65B 31/02* (2006.01)
*B65B 59/04* (2006.01)

(52) U.S. Cl.
CPC ..... *B65B 31/024* (2013.01); *B65B 59/04* (2013.01); *B65B 2210/06* (2013.01)

(58) Field of Classification Search
CPC ... B65B 2210/06; B65B 31/024; B65B 59/04; B65B 31/02–028
(Continued)

(56) References Cited

U.S. PATENT DOCUMENTS 5,239,808 A * 8/1993 Wells ..... B65B 31/024 53/512
6,848,234 B2 * 2/2005 Sung ..... B65B 67/1227 53/284.7

(Continued)

FOREIGN PATENT DOCUMENTS

EP 1925556 A2 5/2008
JP H09249204 A * 9/1997

OTHER PUBLICATIONS

Machine translation of JP-H09249204-A to Takanashi (Year: 1997).*
International Search Report & Written Opinion dated Sep. 26, 2022 from PCT Application No. PCT/IT2022/050181.

*Primary Examiner* — Anna K Kinsaul
*Assistant Examiner* — Himchan Song
(74) *Attorney, Agent, or Firm* — INNOVATION CAPTIAL LAW GROUP, LLP; Vic Lin

(57) ABSTRACT

A vacuum packaging machine comprising a support and containment frame (10), the frame (10) is equipped with a control panel (14) and an ON/OFF button (16) and containing a decompression chamber (13) configured for a vacuum packaging of a product. The decompression chamber (13) includes a tank (11) covered by a tilting bell or lid (12). The frame (10) comprises a vacuum pump. at least one welding bar (18) and two lateral sides (19) equipped with cooling slits (20). In at least one lateral sides (19) of the frame (10). is placed an insert (21). shaped and removable, fixed at the tank (11).

8 Claims, 1 Drawing Sheet

(58) Field of Classification Search
USPC ..... 53/434, 512
See application file for complete search history.

(56) References Cited

U.S. PATENT DOCUMENTS

| | | | | |
|---|---|---|---|---|
| 2009/0255221 | A1* | 10/2009 | Lyman, Jr. ..... | B65B 31/046<br>53/512 |
| 2014/0069057 | A1* | 3/2014 | Steidele ..... | B65B 31/024<br>53/405 |
| 2015/0052850 | A1* | 2/2015 | Rausch ..... | B65B 51/148<br>53/86 |
| 2015/0135641 | A1* | 5/2015 | Hu ..... | B65B 31/024<br>53/86 |

* cited by examiner

VACUUM PACKAGING MACHINE

The present invention relates generally to a vacuum packaging machine. More specifically, the invention relates to a vacuum packaging machine, particularly but not exclusively for liquids, with removable sides for a greater cleanliness.

According to the prior art, in general, packaging using vacuum packaging machines is accomplished by introducing the product to be packaged inside a plastic bag or container suitable for vacuum packaging and placing the bag containing the product inside a decompression chamber comprising a tank and a tilting bell or lid comprising elements suitable for sealing the bag or container and maintaining the vacuum within said tank.

Closing the tilting bell or lid on the tank then starts a suction cycle by means of a pump.

At the end of the cycle, when the residual pressure inside the vacuum chamber reaches 1 or 2 mbar absolute, sealing of the bag containing the product is carried out using the same pressure difference between the inside of the decompression chamber and the atmosphere through membranes connected to the welding bars of the tilting bell or lid and to an electrovalve.

Once the sealing phase is complete, atmospheric air enters in the decompression chamber, and the atmospheric pressure allows the bag to fully adhere to the packaged product while ensuring the sealing of the package.

In fact, if the package were to be opened or damaged, the bag would no longer adhere to the packaged product, thus putting the eventual buyer of the product on alert.

Not only solid foods, but also beverages and liquid foods (such as beverages, creams, soups, and sauces) can be packed with vacuum packaging machines, in order to ensure that the product maintains its qualities over time For a frequent practice of liquid vacuum packaging, a vacuum chamber machine with a double-height tank is used; this is a type of vacuum chamber machine with a tank that has a kind of sump, located just below the welding bar, which is useful for placing the bag vertically and avoiding, even better, the spillage of liquids; this solution is useful because of the convenience and speed with which even large quantities of liquids can be packaged.

Almost all the machines, moreover, have special shelves that when applied allow standard use of the machine, which can therefore also be used to vacuum normal quantities of product.

However, in all known types of machines it is particularly inconvenient to clean the inside of the machine, once it has been used, because of the difficult access to the inside of the machine by an operator.

This problem is particularly felt in vacuum packaging machines for liquids considering that, as is well known, if the value of atmospheric pressure is lowered, water boils at a temperature below 100° C., and if the pressure is decreased, there is automatically a decrease in the temperature threshold at which water boils (in fact, in the mountains, at an altitude of 2100 meters corresponding to an atmospheric pressure of about 700 mbar, water boils at 90° C., and at 6000 meters corresponding to a pressure of about 470 mbar, water boils at 80° C.).

Based on the above, therefore, by making a vacuum of 99.5% in a food container of a vacuum machine, the total pressure of the atmosphere inside is reduced to about 5 mbar, and this lowers the boiling threshold of water to room temperature, resulting in splashing of the liquid inside the bag that could leak.

Hence the need to clean the inside of the machine frequently and in an easy and practical way.

Thus, the aim of the present invention is to overcome the technical problems mentioned above and, in particular, is to make a vacuum packaging machine, which allows it to be cleaned internally more frequently and more effectively than the prior art.

Another aim of the invention is to realize a vacuum packaging machine, which is extremely reliable, simple and economical, compared with the advantages achieved.

These and other aims are achieved by means of a vacuum packaging machine, according to claim 1 attached hereby; other detailed features are set forth in subsequent claims.

Further aims and advantages of the present invention will be clear from the description that follows, relating to an example embodiment that is illustrative and preferred, but not limiting, and from the accompanying drawings, wherein.

Figure 1:
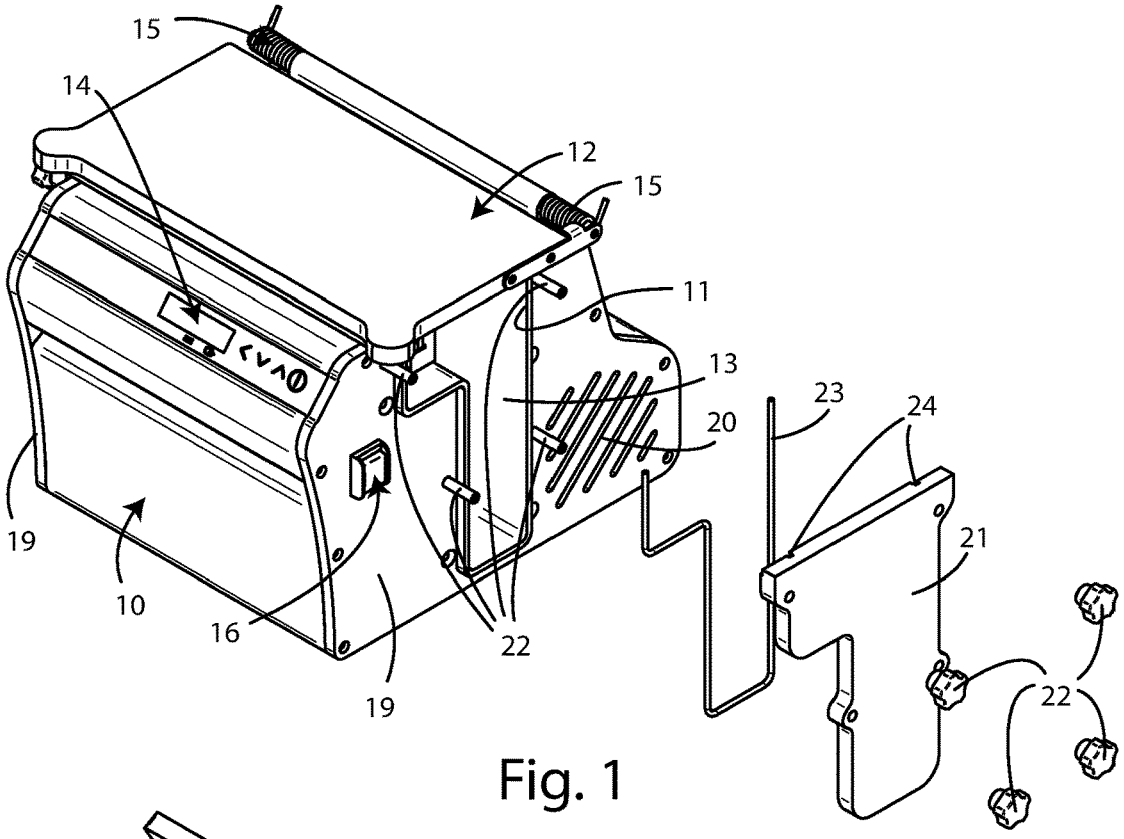
FIG. 1 shows a perspective view of a vacuum packaging machine made according to the present invention.
Figure 2:
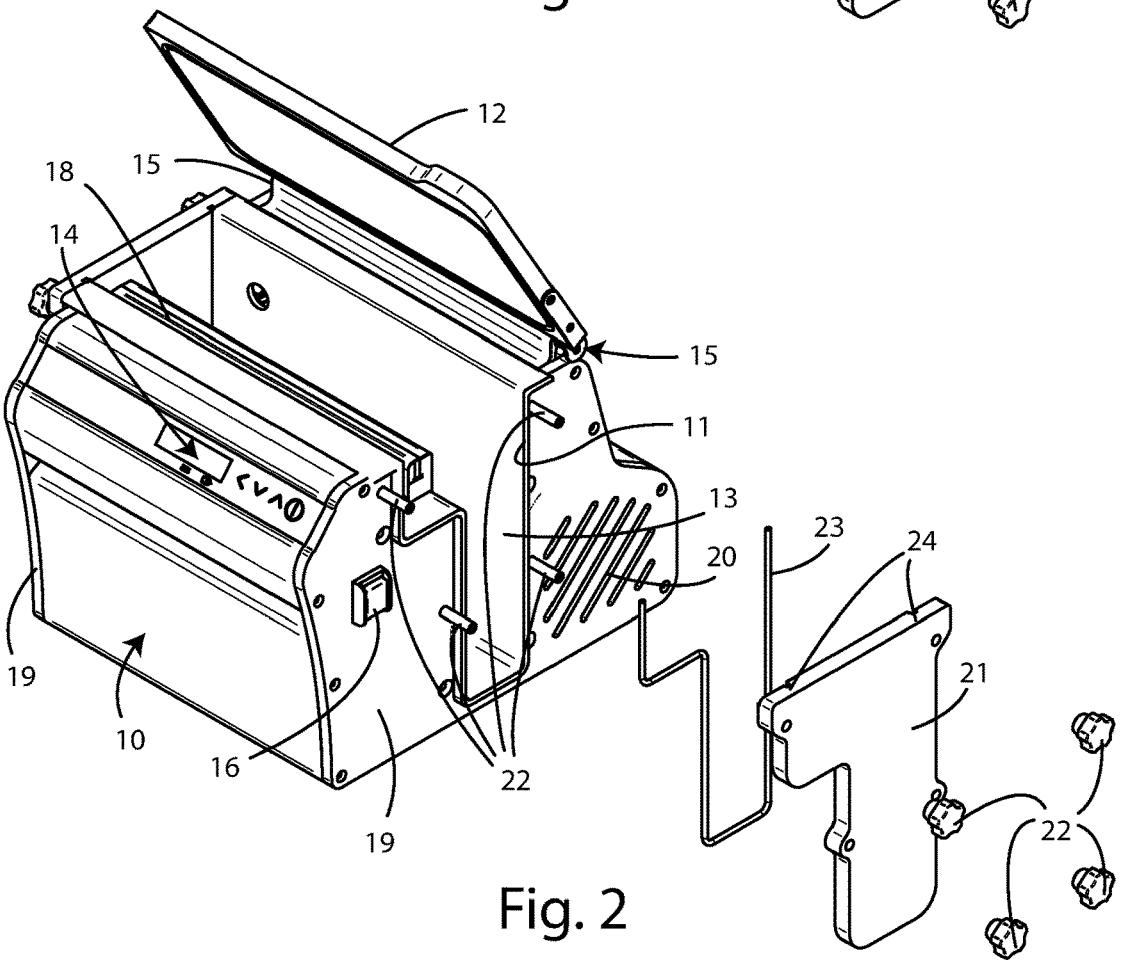
FIG. 2 shows a perspective view of the vacuum packaging machine of FIG. 1, with the lid raised.

It should first be noted that, although reference will be made in the remainder of this description, relative to the attached figure, to a vacuum packaging machine for liquids, the features and the protections indicated apply similarly to vacuum packaging machines of any type.

With particular reference to the attached figure, the vacuum packaging machine according to the present invention comprises a support and containment frame 10, provided with a control panel 14 and an ON/OFF button 16 and suitable for containing within it the functional parts of the machine.

Advantageously, the support and containment frame 10 locates an internal decompression chamber 13 for vacuum packaging of a product, for example within a plastic bag or other suitable container.

Still advantageously, the decompression chamber 13 includes a tank 11 covered by a tilting bell or lid 12, possibly equipped with extenders or hinges 15 for easy opening and suitable for sealing the open edges of the bag by means of internal welding bars 18.

Still advantageously, the support and containment frame 10 also includes an interior space, where all the functional components of the machine are attached, including, in particular, a vacuum pump, and two lateral sides 19, at least one of which has cooling slits 20.

According to the present invention, it is contemplated to make, on at least one lateral sides 19 of the machine, at least one shaped and removable insert 21 to be fixed in a position corresponding to the tank 11.

Advantageously, two removable inserts 21 located on the lateral sides 19 of the frame 10 and attached to the tank 11 are used.

The removable inserts 21 are attached to the tank 11 by means of screws and/or knobs 22, by means of a gasket 23 that is inserted into a seat 24 of the removable insert 21 at at least a portion of the cross-sectional perimeter of the tank 11. The gasket 23 allows the watertight seal of the tank 11 and superiorly the tilting bell or lid 12 makes a seal on the tank 11.

Thus, it is possible to easily remove the inserts 21 located on the lateral sides 19 of the machine to perform, in a simple and practical manner, more cleaning of the tank 11 than the known art.

From the description made, the technical features of the vacuum packaging machine, object of the present invention, are clear, as are its advantages. Finally, it is clear that a preferred form of embodiment of the present invention has been described in the foregoing, but it is to be understood that experts in the art may make modifications and changes without thereby departing from the relevant scope of protection as defined by the appended claims.

The invention claimed is:

1. A vacuum packaging machine, comprising a support and containment frame (10), said frame (10) being equipped with a control panel (14) and an ON/OFF button (16) and containing a decompression chamber (13) configured for a vacuum packaging of a product, said chamber (13) including a tank (11) covered by a tilting bell or lid (12), wherein said support and containment frame (10) comprises a vacuum pump, at least one welding bar (18) and two lateral sides (19) equipped with cooling slits (20), characterized in that at least one shaped and removable insert (21) is placed on at least one of said lateral sides (19) of said support and containment frame (10), said insert (21) being fixed at said tank (11) and wherein said at least one insert (21) is fixed to said tank (11) by means of screws and/or knobs (22).

2. The vacuum packaging machine as claimed in claim 1, characterized in that one or two of the at least one insert (21) are placed on one or two respective lateral sides (19) of said frame (10), said inserts (21) being fixed at said tank (11).

3. The vacuum packaging machine as claimed in claim 1, characterized in that said at least one insert (21) is fixed to said tank (11) by means of a gasket (23) which is inserted in a seat (24), said seat (24) being obtained on said at least one insert (21) and at a portion of the perimeter of said tank (11), said gasket (23) and said tilting lid (12) being configured to maintain the watertight seal of the tank (11).

4. The vacuum packaging machine as claimed in claim 1, characterized in that said machine is used for solid and liquid food and drinks.

5. A vacuum packaging machine, comprising a support and containment frame (10), said frame (10) being equipped with a control panel (14) and an ON/OFF button (16) and containing a decompression chamber (13) configured for a vacuum packaging of a product, said chamber (13) including a tank (11) covered by a tilting bell or lid (12), wherein said support and containment frame (10) comprises a vacuum pump, at least one welding bar (18) and two lateral sides (19) equipped with cooling slits (20), characterized in that at least one shaped and removable insert (21) is placed on at least one of said lateral sides (19) of said support and containment frame (10), said insert (21) being fixed at said tank (11), wherein said at least one insert (21) is fixed to said tank (11) by means of a gasket (23) which is inserted in a seat (24), said seat (24) being obtained on said at least one insert (21) and at a portion of the perimeter of said tank (11), said gasket (23) and said tilting lid (12) being configured to maintain the watertight seal of the tank (11).

6. The vacuum packaging machine as claimed in claim 5, characterized in that one or two of the at least one insert (21) are placed on one or two respective lateral sides (19) of said frame (10), said inserts (21) being fixed at said tank (11).

7. The vacuum packaging machine as claimed in claim 5, characterized in that said at least one insert (21) is fixed to said tank (11) by means of screws and/or knobs (22).

8. The vacuum packaging machine as claimed in claim 5, characterized in that said machine is used for solid and liquid food and drinks.

* * * * *